US010365571B2

(12) United States Patent
Takemori et al.

(10) Patent No.: US 10,365,571 B2
(45) Date of Patent: Jul. 30, 2019

(54) ELECTROSTATIC LATENT IMAGE DEVELOPING TONER

(71) Applicant: KYOCERA Document Solutions Inc., Osaka (JP)

(72) Inventors: Toshiki Takemori, Osaka (JP); Kohei Yamauchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/904,785

(22) Filed: Feb. 26, 2018

(65) Prior Publication Data

US 2018/0259866 A1 Sep. 13, 2018

(30) Foreign Application Priority Data

Mar. 9, 2017 (JP) ..... 2017-044850

(51) Int. Cl.
*G03G 9/08* (2006.01)
*G03G 9/087* (2006.01)

(52) U.S. Cl.
CPC ..... *G03G 9/0825* (2013.01); *G03G 9/0819* (2013.01); *G03G 9/0827* (2013.01); *G03G 9/08755* (2013.01); *G03G 9/08795* (2013.01); *G03G 9/08797* (2013.01)

(58) Field of Classification Search
CPC ..... G03G 9/08; G03G 9/087; G03G 9/08711; G03G 9/08755; G03G 9/0825; G03G 9/0819
See application file for complete search history.

(56) References Cited

U.S. PATENT DOCUMENTS 9,366,982 B2 6/2016 Yamamoto et al.
2005/0175920 A1* 8/2005 Tsurumi ..... G03G 9/0819 430/108.8
2008/0286668 A1* 11/2008 Ishigami ..... G03G 9/0821 430/48
2011/0256479 A1* 10/2011 Ueda ..... G03G 9/0819 430/124.3

(Continued)

FOREIGN PATENT DOCUMENTS

JP 2011145587 A * 7/2011
JP 2014-224843 A 12/2014

*Primary Examiner* — Christopher D Rodee
(74) *Attorney, Agent, or Firm* — Studebaker & Brackett PC

(57) ABSTRACT

An electrostatic latent image developing toner includes a plurality of toner particles containing a non-crystalline polyester resin and a crystalline polyester resin. The toner particles contain as the crystalline polyester resin a dispersoid of crystallized crystalline polyester resin (CPES) domains. The CPES domains of the CPES dispersoid have an aspect ratio of at least 3.40 and no greater than 10.0 in terms of number average value. The toner particles have a roundness of at least 0.950 and no greater than 0.970 in terms of number average value. In a cross-sectional image of each of the toner particles, a ratio of a total area occupied by the CPES dispersoid to a cross-sectional area of the toner particle is at least 10.0% and no greater than 30.0%. The non-crystalline polyester resin includes a repeating unit derived from alkenyl succinic anhydride. The crystalline polyester resin includes a repeating unit derived from n-butyl methacrylate.

7 Claims, 3 Drawing Sheets

(56) References Cited

U.S. PATENT DOCUMENTS

| | | | | |
|---|---|---|---|---|
| 2011/0294061 | A1* | 12/2011 | Shirai | C08G 63/00 430/109.1 |
| 2014/0342283 | A1* | 11/2014 | Yamamoto | G03G 9/0819 430/109.4 |
| 2014/0363763 | A1* | 12/2014 | Shibata | G03G 9/08724 430/109.3 |
| 2015/0099224 | A1* | 4/2015 | Abe | G03G 9/09328 430/110.2 |
| 2016/0363878 | A1* | 12/2016 | Hama | G03G 9/08755 |
| 2017/0075243 | A1* | 3/2017 | Umeda | G03G 9/0825 |
| 2017/0160663 | A1* | 6/2017 | Arimura | G03G 9/0819 |
| 2017/0227873 | A1* | 8/2017 | Sugawara | G03G 9/0902 |

* cited by examiner

ELECTROSTATIC LATENT IMAGE DEVELOPING TONER

INCORPORATION BY REFERENCE

The present application claims priority under 35 U.S.C. § 119 to Japanese Patent Application No. 2017-044850, filed on Mar. 9, 2017. The contents of this application are incorporated herein by reference in their entirety.

BACKGROUND

The present disclosure relates to an electrostatic latent image developing toner.

Among techniques for toners, a toner has been known that contains urethane or a crystalline resin having a urea bond and that includes toner particles each having a sea-island structure in cross section. In the sea-island structure, the crystalline resin is dispersed in a non-crystalline resin.

SUMMARY

An electrostatic latent image developing toner according to the present disclosure includes a plurality of toner particles containing a non-crystalline polyester resin and a crystalline polyester resin. The toner particles contain as the crystalline polyester resin a dispersoid of crystallized crystalline polyester resin (CPES) domains. The CPES domains of the CPES dispersoid have an aspect ratio of at least 3.40 and no greater than 10.0 in terms of number average value. The toner particles have a roundness of at least 0.950 and no greater than 0.970 in terms of number average value. In a cross-sectional image of each of the toner particles, a ratio of a total area occupied by the CPES dispersoid to a cross-sectional area of the toner particle is at least 10.0% and no greater than 30.0%. The non-crystalline polyester resin includes a repeating unit derived from alkenyl succinic anhydride. The crystalline polyester resin includes a repeating unit derived from n-butyl methacrylate.

DETAILED DESCRIPTION

Figure 1:
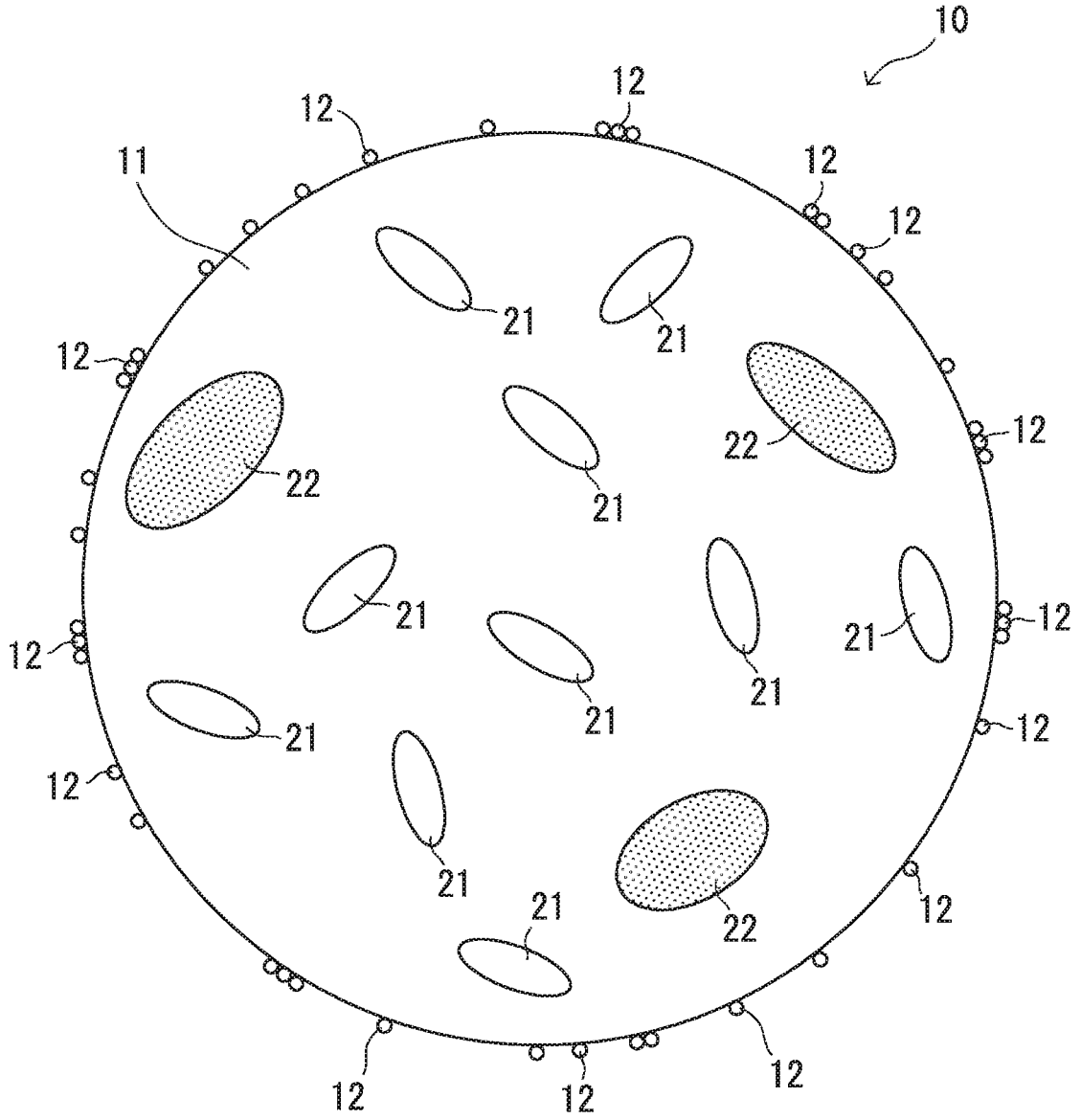
FIG. 1 is a diagram illustrating an example of a cross-sectional structure of a toner particle included in an electrostatic latent image developing toner according to an embodiment of the present disclosure.

An embodiment of the present disclosure will be described below. Note that evaluation results (values indicating shape, physical properties, or the like) for a powder (for example, toner mother particles, an external additive, or a toner) are number average values measured with respect to an appropriate number of particles unless otherwise stated.

A number average primary particle diameter of a powder is a number average value of equivalent circle diameters of primary particles of the powder (diameters of circles having the same areas as projected areas of the particles) measured using a microscope unless otherwise stated. A value for a volume median diameter ($D_{50}$) of a powder is a value measured using "Coulter Counter Multisizer 3" produced by Beckman Coulter, Inc. based on Coulter principle (an electric sensing zone method) unless otherwise stated.

Unless otherwise stated, a softening point (Tm) is a value measured using a capillary rheometer ("CFT-500D" manufactured by Shimadzu Corporation). The softening point (Tm) corresponds to a temperature at a point on an S-shaped curve (horizontal axis: temperature, vertical axis: stroke) plotted using the capillary rheometer, at which point the stroke value is "(base line stroke value+maximum stroke value)/2". A measured value for a melting point (Mp) is a temperature at a maximum heat absorption peak on a heat absorption curve (vertical axis: heat flow (DSC signals), horizontal axis: temperature) plotted using a differential scanning calorimeter ("DSC-6220" produced by Seiko Instruments Inc.) unless otherwise stated. Respective measured values for a number average molecular weight (Mn) and a mass average molecular weight (Mw) are values measured using a gel permeation chromatography unless otherwise stated.

A "major component" of a material refers to a component of the material that is contained the most on a mass basis unless otherwise stated.

Unless otherwise stated, chargeability refers to chargeability in triboelectric charging. Intensity of positive chargeability (or negative chargeability) in triboelectric charging can be determined for example using a known triboelectric series.

In the present description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof.

A toner according to the present embodiment can be used favorably for development of electrostatic latent images for example as a positively chargeable toner. The toner according to the present embodiment is a powder including a plurality of toner particles (particles each having a later-described configuration). The toner may be used as a one-component developer. Alternatively, a two-component developer may be prepared by mixing the toner with a carrier for example using a mixer (e.g., a ball mill). A ferrite carrier (a powder of ferrite particles) is an example of a carrier suitable for image formation. In order to form high-quality images durable for a long period of time, magnetic carrier particles each including a carrier core and a resin layer covering the carrier core are preferably used. Preferably, the resin layer entirely covers the surface of the carrier core (that is, the carrier core has no surface region exposed through the resin layer) in order to ensure sufficient properties of the carrier for imparting charge to the toner for a long term. In order to impart magnetism to the carrier particles, the carrier cores may be made from a magnetic material (e.g., a ferromagnetic material such as ferrite) or a resin in which magnetic particles are dispersed. Alternatively, the magnetic particles may be dispersed in the resin layers covering the carrier cores. Examples of resins constituting the resin layers include at least one resin selected from the group consisting of fluororesins (specific examples include perfluoroalkoxy alkane (PFA) and fluorinated ethylene propylene (FEP)), polyamide-imide resins, silicone resins, urethane resins, epoxy resins, and phenolic resins. The toner is preferably contained in the two-component developer in an amount of at least 5 parts by mass and no greater than 15 parts by mass relative to 100 parts by mass of the carrier order to form high-quality images. The carrier preferably has a number average primary particle diameter of at least 20 μm and no greater than 120 μm. Note that a positively chargeable toner contained in a two-component developer is positively charged by friction with the carrier. By contrast, a negatively chargeable toner contained in a two-component developer is negatively charged by friction with the carrier.

The toner according to the present embodiment can be used for example for image formation using an electrophotographic apparatus (image forming apparatus). The following describes an example of an image forming method using an electrophotographic apparatus.

First, an image forming section (for example, a charger and a light exposure device) of an electrophotographic apparatus forms an electrostatic latent image on a photosensitive member (for example, on a surface layer portion of a photosensitive drum) based on image data. Subsequently, a development device (specifically, a development device charged with developer containing toner) of the electrophotographic apparatus supplies the toner to the photosensitive member to develop the electrostatic latent image formed on the photosensitive member. The toner is charged in the development device by friction with carrier, a development sleeve, or a blade before being supplied to the photosensitive member. For example, a positively chargeable toner is positively charged. In a development process, toner (specifically, charged toner) on the development sleeve (e.g., a surface layer portion of a development roller of the development device) disposed in the vicinity of the photosensitive member is supplied to the photosensitive member and attached to an exposed part of the electrostatic latent image on the photosensitive member to form a toner image on the photosensitive member. The development device is replenished with toner in the amount corresponding to that of toner consumed in the development process from a toner container accommodating toner for replenishment use.

In a subsequent transfer process, a transfer device of the electrophotographic apparatus transfers the toner image on the photosensitive member to an intermediate transfer member (e.g., a transfer belt) and further transfers the toner image from the intermediate transfer member to a recording medium (e.g., paper). Thereafter, a fixing device (fixing method: nip fixing using a heating roller and a pressure roller) of the electrophotographic apparatus fixes the toner to the recording medium by applying heat and pressure to the toner. As a result, an image is formed on the recording medium. For example, a full color image can be formed by superimposing toner images in four colors of black, yellow, magenta, and cyan. After the transfer process, residual toner on the photosensitive member is removed by a cleaning member (e.g., a cleaning blade). Note that the transfer process may be a direct transfer process by which the toner image on the photosensitive member is directly transferred to the recording medium not via the intermediate transfer member. Furthermore, the fixing process may be a belt fixing process.

The toner according to the present embodiment includes a plurality of toner particles. The toner particles may contain an external additive. In a configuration in which the toner particles contain an external additive, the toner particles each include a toner mother particle and the external additive. The external additive is attached to surfaces of the toner mother particles. The toner mother particles contain a binder resin. The toner mother particles may contain an internal additive (for example, at least one of a releasing agent, a colorant, a charge control agent, and a magnetic powder) as necessary in addition to the binder resin. In a situation in which an external additive is not necessary, the external additive may be omitted. In a configuration in which the external additive is omitted, the toner mother particle and the toner particle are equivalent.

The toner according to the present embodiment is an electrostatic latent image developing toner having the following features (also referred to below as basic features).

(Basic Features of Toner)

The toner includes a plurality of toner particles containing a non-crystalline polyester resin as a binder resin. The toner particles further contain a dispersoid of crystallized crystalline polyester resin domains (also referred to below as a CPES dispersoid) as a binder resin. The CPES domains of the CPES dispersoid have an aspect ratio of at least 3.40 and no greater than 10.0 in terms of number average value. The toner particles have a roundness of at least 0.950 and no greater than 0.970 in terms of number average value. In a cross-sectional image of each of the toner particles, a ratio of a total area occupied by the CPES dispersoid to a cross-sectional area of the toner particle is at least 10.0% and no greater than 30.0%.

Hereinafter, the crystallized crystalline polyester resin domains may be also referred to as "CPES domains". Also, the aspect ratio (number average value) of the CPES domains of the CPES dispersoid may be referred to below as a "CPES aspect ratio". The ratio of the total area occupied by the CPES dispersoid to the cross-sectional area of each of the toner panicles in the cross-sectional image of the toner particle may be also referred to below as a "CPES area ratio". Note that measuring methods of the CPES aspect ratio and the CPES area ratio are the same as those described later in Examples or alternative methods thereof.

The "aspect ratio" in the above basic features corresponds to a value obtained by dividing a major axis diameter by a minor axis diameter (major axis diameter)/(minor axis diameter)) of a CPES domain. The "major axis diameter" of the CPES domain refers to a length of a major axis thereof and more specifically corresponds to a width of the CPES domain where a distance between two parallel lines interposing the CPES domain is maximum. The "minor axis diameter" of the CPES domain refers to a length of a minor axis of the CPES domain and more specifically corresponds to a width of the CPES domain measured on a straight line passing through the center of the major axis and perpendicularly crossing the major axis.

A technique to improve low-temperature fixability of a toner by toner particles containing a non-crystalline polyester resin and a crystalline polyester resin is typically known. In such a technique, a non-crystallized crystalline polyester resin is used to compatibilize a non-crystalline polyester resin and the crystalline polyester resin in the toner particles. By contrast, the crystallized crystalline polyester resin in a specific aspect is contained in the toner particles in the above basic features. The present inventor has found that use of the crystallized crystalline polyester resin can improve heat-resistant preservability of the toner. Crystallization of the crystalline polyester resin causes phase separation between the non-crystalline polyester resin and the crystalline polyester resin in the toner particles.

The toner (specifically, the toner particles defined by the above basic features) preferably has a roundness of at least 0.950 and no greater than 0.970 in terms of number average value. When the roundness of the toner particles is excessively high, ease of toner cleaning may be impaired. Specifically, the toner particles are liable to easily pass through spaces between a photosensitive drum and a cleaning blade. When the roundness of the toner particles is excessively low, fluidity of the toner may be impaired or adhesion of the toner may increase. Note that in a configuration in which the toner particles contain an external additive, the roundness defined in the above basic features refers to a roundness of the toner particles subjected to external addition. However, ignorable difference in roundness of the toner particles is present between before and after external addition.

The CPES area ratio tends to increase as crystallization of the crystalline polyester resin proceeds. Insufficient crystallization of the crystalline polyester resin inhibits the crystalline polyester resin in the toner particles from working for improving heat-resistant preservability of the toner. When the crystallized CPES domains become excessively large, the crystalline polyester resin in the toner particles may impair fixability of the toner. In order that the toner has both heat-resistant preservability and low-temperature fixability, the CPES area ratio is preferably at least 10.0% and no greater than 30.0%.

The crystallized crystalline polyester resin has low electric resistance. The electric resistance of the crystallized crystalline polyester resin is lower than that of the non-crystalline polyester resin. The CPES domains are preferably dispersed in the entirety of each of the toner mother particles. When the number average aspect ratio of the CPES dispersoid (CPES domains dispersed in the toner particles) is excessively high, the CPES domains tend to be in contact with one another to form conductive paths. The conductive paths formed as above serve as escape routes of charges to inhibit toner charging. In order to ensure sufficient chargeability of the toner in continuous printing, the CPES aspect ratio is preferably at least 3.40 and no greater than 10.0 in terms of number average value. A direction of the major axis of each of the CPES domains corresponds to a direction of crystal growth thereof. Therefore, the CPES domains that are crystallized to an appropriate degree are thought to have an appropriately high aspect ratio.

In order to reduce the aspect ratio of CPES domains having a sufficiently long major axis diameter to at least 3.00, it is necessary to increase the size of the CPES domains. However, too large CPES domains may inhibit toner charging. Furthermore, large CPES domains tend to be exposed from surfaces of the toner particles. When the amount of CPES domains exposed from the surfaces of the toner particles is increased, charge stability of the toner tends to be unpaired.

In order to obtain a toner excellent in heat-resistant preservability, low-temperature fixability, chargeability, and pulverization characteristics, it is preferable that the major axis diameter of the CPES domains in the toner particles is at least 0.50 μm and no greater than 1.00 μm in terms of number average value and the minor axis diameter of the CPES domains in the toner particles is at least 0.05 μm and no greater than 0.25 μm in terms of number average value. Hereinafter, the major axis diameter of the CPES domains may be referred to as a "CPES major axis diameter" and the minor axis diameter thereof may be referred to as a "CPES minor axis diameter".

In order that the toner has both heat-resistant preservability and low-temperature fixability, it is preferable that: the amount of the crystalline polyester resin is at least 40 parts by mass and no greater than 95 parts by mass relative to 100 parts by mass of the non-crystalline polyester resin; the softening point of the non-crystalline polyester resin (specifically, the non-crystalline polyester resin in the toner particles) obtained by differential scanning calorimetry is at least 110° C. and no greater than 140° C.; and the softening point of the crystalline polyester resin (specifically, the crystalline polyester resin in the toner particles) obtained by differential scanning calorimetry is at least 75° C. and no greater than 90° C. The non-crystalline polyester resin preferably has an acid value of at least 5 mgKOH/g and no greater than 30 mgKOH/g in order to ensure sufficient low-temperature fixability of the toner. Furthermore, the non-crystalline polyester resin preferably has a hydroxyl value of at least 20 mgKOH/g and no greater than 40 mgKOH/g in order to ensure sufficient low-temperature fixability of the toner.

In order to obtain a toner excellent in heat-resistant preservability, low-temperature fixability, chargeability, and pulverization characteristics, it is preferable that: the non-crystalline polyester resin in the toner particles is a resin containing a bisphenol as an alcohol component; and the crystalline polyester resin (specifically the crystalline polyester resin constituting the CPES domains) in the toner particles is a polymer of monomers (resin raw materials) including at least one alcohol monomer, at least one carboxylic acid monomer, at least one styrene-based monomer, and at least one acrylic acid-based monomer.

The following describes an example of the toner particles included in the toner having the above basic features with reference to FIG. 1. FIG. 1 is a diagram illustrating a cross-sectional structure of a toner particle 10 included in the toner.

The toner particle 10 illustrated in FIG. 1 includes a toner mother particle and an external additive (i.e., a plurality of external additive particles 12). The external additive is attached to a surface of the toner mother particle. The toner mother particle contains a binder resin 11, a crystalline polyester resin (i.e., a plurality of CPES domains 21), and a releasing agent (i.e., a plurality of releasing agent domains 22). The crystalline polyester resin and the releasing agent are dispersed in the binder resin 11. The CPES domains 21 and the releasing agent domains 22 are dispersed in the entirety of the toner mother particle. The external additive particles 12 are for example silica particles.

Figure 2:
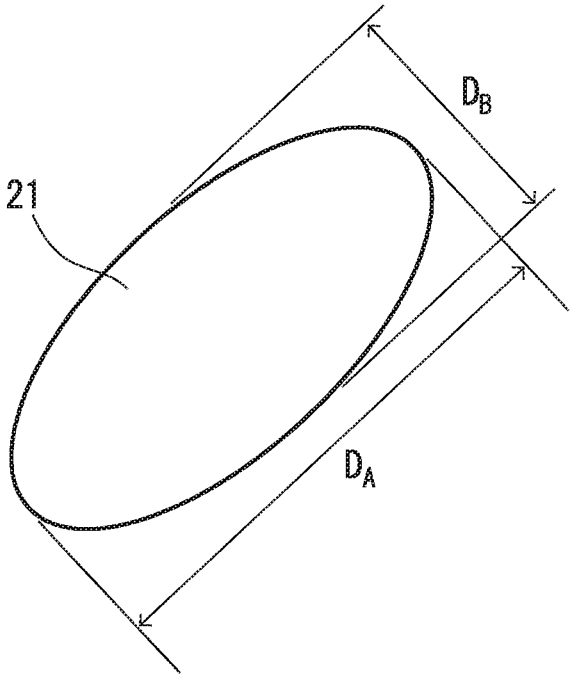
FIG. 2 is a diagram illustrating in an enlarged scale a crystalline polyester resin domain in the toner particle illustrated in FIG. 1.

FIG. 2 illustrates one of the CPES domains 21 in an enlarged scale. In the CPES domain 21 illustrated in FIG. 2, $D_A$ represents a major axis diameter and $D_B$ represents a minor axis diameter. Accordingly, "$D_A/D_B$" corresponds to the aspect ratio.

Typically, toners are roughly categorized into a pulverized toner and a polymerized toner (also called a chemical toner). A toner produced by a pulverization method belongs to the pulverized toner, and a toner produced by an aggregation method belongs to the polymerized toner. The toner having the above basic features is preferably a pulverized toner. In order that the toner has both heat-resistant preservability and low-temperature fixability, the toner particles particularly preferably contain at least one crystalline polyester resin and at least one non-crystalline polyester resin that are melt-kneaded together.

The toner mother particles preferably have a volume median diameter ($D_{50}$) of at least 4 μm and no greater than 9 μm in order to obtain a toner suitable for image formation.

In order to obtain a toner suitable for image formation, the toner preferably includes the toner particles defined by the above basic features at a rate of at least 80% by number, more preferably at least 90% by number, and further preferably 100% by number.

The following describes a preferable example of the configuration of the toner particles (specifically, non-capsule toner particles). The toner mother particles and the external additive will be described in stated order. An unnecessary component may be omitted according to use of the toner.

[Toner Mother Panicles]

(Non-crystalline Polyester Resin)

The toner mother particles of the toner having the above basic features contain a non-crystalline polyester resin. The non-crystalline polyester resin functions as a binder resin. The non-crystalline polyester resin is preferably a major component of the toner mother particles.

The polyester resin can be obtained by condensation polymerization of one or more polyhydric alcohols (specific examples include the following aliphatic diols, bisphenols, and tri- or higher-hydric alcohols) and one or more polybasic carboxylic acids (specific examples include the following dibasic carboxylic acids and tri- or higher-basic carboxylic acids). The polyester resin may optionally include a repeating unit derived from another monomer (monomer other than the polyhydric alcohols and the polybasic carboxylic acids).

Preferable examples of the aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanedial, 1,6-hexanediol, 1,7-heptanediol, 1,8-octanediol, 1,9-nonanediol, and 1,12-dodecanediol), 2-butene-1,4-diol, 1,4-cyclohexanedimethanol, dipropylene glycol, polyethylene glycol, polypropylene glycol, and polytetramethylene glycol.

Preferable examples of the bisphenols include bisphenol A, hydrogenated bisphenol A, bisphenol A ethylene oxide adduct, and bisphenol A propylene oxide adduct.

Preferable examples of the td- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, tri methylol ethane, trimethylolpropane, and 1,3,5-trihydroxymethylbenzene.

Preferable examples of the dibasic carboxylic acids include aromatic dicarboxylic acids (specific examples include phthalic acid, terephthalic acid, and isophthalic acid), α,ω-alkane dicarboxylic acids (specific examples include malonic acid, succinic acid, adipic acid, suberic acid, azelaic acid, sebacic acid, and 1,10-decanedicarboxylic acid), unsaturated dicarboxylic acids (specific examples include maleic acid, fumaric acid, citraconic acid, itaconic acid, and glutaconic acid), and cycloalkane dicarboxylic acids (specific example is cyclohexanedicarboxylic acid).

Preferable examples of the tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and EMPOL trimer acid.

A preferable example of the non-crystalline polyester resin is a non-crystalline polyester resin containing a bisphenol (e.g., either or both of bisphenol A ethylene oxide adduct and bisphenol A propylene oxide adduct) an alcohol component and either or both of an aromatic dicarboxylic acid (e.g., terephthalic acid) and an unsaturated dicarboxylic acid (e.g., fumaric acid) as an acid component.

(Crystalline Polyester Resin)

The toner mother particles of the toner having the above basic features contain a crystalline polyester resin. Specifically, the CPES domains (crystalline polyester resin domains) in a crystallized state are dispersed in the toner mother particles.

The crystalline polyester resin is preferably a polymer of monomers (resin raw materials) including at least one alcohol monomer, at least one carboxylic acid monomer, at least one styrene-based monomer, and at least one acrylic acid-based monomer. A particularly preferable alcohol monomer is an α,ω-alkanediol having a carbon number of at least 2 and no greater than 10 (e.g., 1,6-hexanediol having a carbon number of 6). In order to obtain a crystalline polyester resin that is readily crystallized, the alcohol component of the crystalline polyester resin preferably includes at least 70% by mole of an α,ω-alkanediol having a carbon number of at least 2 and no greater than 10 and particularly preferably includes 100% by mole of the α,ω-alkanediol having a carbon number of at least 2 and no greater than 10. An aliphatic dicarboxylic acid having a carbon number of at least 4 and no greater than 16 (e.g., fumaric acid) is particularly preferable as the carboxylic acid monomer. In order to obtain a crystalline polyester resin that is readily crystallized, the acid component of the crystalline polyester resin preferably includes at least 70% by mole of an aliphatic dicarboxylic acid having a carbon number of at least 4 and no greater than 16 and particularly preferably includes 100% by mole of the aliphatic dicarboxylic acid having a carbon number of at least 4 and no greater than 16. The carbon number of an aliphatic dicarboxylic acid is a carbon number including the carbon number of a carboxyl group as well. For example, fumaric acid has a carbon number of 4.

(Colorant)

The toner mother particles may contain a colorant. The colorant can be a known pigment or dye that matches the color of the toner. In order to obtain a toner suitable for image formation, the amount of the colorant is preferably at least 1 part by mass and no greater than 20 parts by mass relative to 100 parts by mass of the binder resin.

The toner mother particles may contain a black colorant. Carbon black can for example be used as a black colorant. The black colorant may be a colorant whose color is adjusted to black using a yellow colorant, a magenta colorant, and a cyan colorant.

The toner mother particles may contain a non-black colorant such as a yellow colorant, a magenta colorant, or a cyan colorant.

Examples of yellow colorants that can be used include at least one compound selected from the group consisting of condensed azo compounds, isoindolinone compounds, anthraquinone compounds, azo metal complexes, methine compounds, and arylamide compounds. Examples of yellow colorants that can be preferably used include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

Examples of magenta colorants that can be used include at least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Examples of magenta colorants that can be preferably used include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

Examples of cyan colorants that can be used include at least one compound selected from the group consisting of copper phthalocyanine compounds, anthraquinone compounds, and basic dye lake compounds. Examples of cyan colorants that can be preferably used include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The toner mother particles may contain a releasing agent. The releasing agent is for example used in order to improve fixability of the toner or resistance of the toner to being offset. In order to improve fixability or offset resistance of the toner, the amount of the releasing agent is preferably at least 1 part by mass and no greater than 30 parts by mass relative to 100 parts by mass of the binder resin.

Examples of the releasing agent include aliphatic hydrocarbon waxes such as low molecular weight polyethylenes, low molecular weight polypropylenes, polyolefin copolymers, polyolefin waxes, microcrystalline waxes, paraffin waxes, and Fischer-Tropsch waxes; oxides of aliphatic hydrocarbon waxes such as oxidized polyethylene waxes and block copolymers of oxidized polyethylene waxes; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes containing a fatty acid ester as a major component such as montanic acid ester wax and castor wax; and waxes containing partially or fully deoxidized fatty acid esters such as deoxidized carnauba wax. A single type of releasing agent listed above may be used or plural types of releasing agents listed above may be used in combination.

(Charge Control Agent)

The toner mother particles may contain a charge control agent. The charge control agent is for example used to improve charge stability or a charge rise characteristic of the toner. The charge rise characteristic of the toner is an indicator as to whether the toner can be charged to a specific charge level in a short period of time.

The anionic strength of the toner mother particles can be increased through the toner mother particles containing a negatively chargeable charge control agent (specific examples include an organic metal complex and a chelate compound). The cationic strength of the toner mother particles can be increased through the toner mother particles containing a positively chargeable charge control agent (specific examples include pyridine, nigrosine, and quaternary ammonium salt). However, it is not essential for the toner mother particles to contain a charge control agent if sufficient chargeability of the toner can be ensured without the charge control agent.

(Magnetic Powder)

The toner mother particles may contain a magnetic powder. Examples of materials of the magnetic powder that can be preferably used include ferromagnetic metals (specific examples include iron, cobalt, nickel, and alloys containing at least one of them), ferromagnetic metal oxides (specific examples include ferrite, magnetite, and chromium dioxide), and materials subjected to ferromagnetization (specific examples include carbon materials to which ferromagnetism is imparted through thermal treatment). A single type of magnetic powder listed above may be used or plural types of magnetic powders listed above may be used in combination.

In order to inhibit elution of metal ions e.g., iron ions) from the magnetic powder, the magnetic powder (specifically surfaces of magnetic particles included in the magnetic powder) is preferably subjected to treatment using a surface treatment agent (specific examples include a silane coupling agent and a titanate coupling agent).

[External Additive]

An external additive (specifically, a powder including a plurality of external additive particles) may be attached to the surfaces of the toner mother particles. Unlike the internal additives, the external additive is not present inside the toner mother particles and is selectively present on the surfaces of the toner mother particles (surface layer portions of the toner particles). For example, when the toner mother particles (powder) and the external additive (powder) are stirred together, the external additive particles can be attached to the surfaces of the toner mother particles. The toner mother particles do not chemically react with the external additive particles and are bonded to the external additive particles physically rather than chemically. Bonding strength between the toner mother particles and the external additive particles can be adjusted for example by adjusting the particle diameter, shape, or surface state of the external additive particles or a stiffing condition (specific examples include a stiffing period and rotational speed of stirring).

The amount of the external additive (in configuration in which plural types of external additive particles are used, a total amount of the external additive particles) is preferably at least 0.5 parts by mass and no greater than 10 parts by mass relative to 100 parts by mass of the toner mother particles in order to inhibit detachment of the external additive particles from the toner particles and cause the external additive to sufficiently exhibit its function.

As the external additive particles, inorganic particles are preferable and silica particles or particles of metal oxides specific examples include alumina, titanium oxide, magnesium oxide, zinc oxide, strontium titanate, and barium titanate) are particularly preferable. However, resin particles or particles of an organic acid compound such as a fatty acid metal salt (a specific example is zinc stearate) may be used as the external additive particles. Alternatively, composite particles that contain plural materials may be used as the external additive particles. A single type of external additive particles may be used or plural types of external additive particles may be used in combination.

In order to improve fluidity of the toner, inorganic particles (powder) having a number average primary particle diameter of at least 5 nm and no greater than 30 nm are preferably used as the external additive particles. Resin particles (powder) having a number average primary particle diameter of at least 50 nm and no greater than 200 nm are preferably used as the external additive particles in order to allow the external additive to function as a spacer among the toner particles for improving heat-resistant preservability of the toner.

[Toner Production Method]

A method for producing the toner having the above basic features preferably includes the following melt-kneading process, pulverization process, and crystallization process.

In the melt-kneading process, toner materials including a non-crystallized crystalline polyester resin and a non-crystalline polyester resin are melt-kneaded to obtain a melt-kneaded substance.

The melt-kneaded substance is pulverized to obtain a pulverized substance including a plurality of particles in the pulverization process.

In the crystallization process, the crystalline polyester resin in the pulverized substance is crystallized in a liquid containing the pulverized substance and a dispersant having a mass average molecular weight of at least 3,000 and no greater than 20,000 by keeping the temperature of the liquid at at least the glass transition point of the pulverized substance (also referred to below as Tgc).

When the non-crystallized crystalline polyester resin is melt-kneaded together with the non-crystalline polyester resin without crystallization, the crystalline polyester resin and the non-crystalline polyester resin can be mixed together uniformly. The reason thereof is that the crystalline polyester resin and the non-crystalline polyester resin are compatibilized in the melt-kneaded substance. A melt-kneaded substance obtained as above can be pulverized favorably. When the melt-kneaded substance is pulverized, the pulverized substance (specifically, a powder of particles containing the toner materials) can be obtained. Hereinafter, the particles included in the pulverized substance may be referred to as pre-crystallization particles.

When the crystalline polyester resin contained in the pre-crystallization particles is crystallized in the liquid at a temperature of at least the temperature Tgc, the toner mother particles can be obtained. In order to promote crystallization of the crystalline polyester resin, the temperature of the liquid is preferably at least "Tgc+5° C.". The dispersant used herein preferably has a mass average molecular weight (Mw) of at least 3,000 and no greater than 20,000 in order to inhibit agglomeration and excessive spheroidization of the toner mother particles in the crystallization process. The present inventor found that when a dispersant having a sufficiently large mass average molecular weight is used, excessive spheroidization of the toner mother particles can be inhibited. The toner mother particles preferably have a roundness of at least 0.950 and no greater than 0.970 in terms of number average value. When the toner mother particles have an excessively high roundness, ease of toner cleaning may be impaired. When the toner mother particles have an excessively low roundness, fluidity of the toner may reduce or adhesion of the toner may increase. When a dispersant having an appropriately large mass average molecular weight (specifically, Mw of at least 3,000 and no greater than 20,000) is used, spheroidization of the toner mother particles can proceed to an appropriate degree. Spheroidization of the toner mother particles can proceed simultaneously with crystallization of the crystalline polyester resin in the above toner production method. This can achieve high production efficiency. Any of anionic surfactants, cationic surfactants, and nonionic surfactants can be used as the dispersant. However, a cationic surfactant is preferably used as the dispersant in order not to impair positive chargeability of the toner. An acrylic acid-based polymer is particularly preferable as the dispersant.

The pulverized substance preferably has a roundness (in terms of number average value) of at least 0.930 and no greater than 0.945 before the crystallization process and at least 0.950 and no greater than 0.970 after the crystallization process in order to produce a toner suitable for image formation at high productivity.

The temperature of the liquid in the crystallization process is preferably no greater than "Tgc+30° C." (temperature 30° C. higher than the glass transition point of the pulverized substance) in order to inhibit agglomeration of the toner mother particles and elution of the toner materials in the crystallization process. The liquid containing the pre-crystallization particles is preferably kept at at least Tgc for example for at least 30 minutes and no greater than 120 minutes.

A time when the crystallization process is ended may be determined according to the roundness of the pulverized substance. That is, the roundness of the pulverized substance is checked and the liquid may be cooled when the roundness of the pulverized substance reaches a specific value. Alternatively, the liquid containing the pre-crystallization particles may be kept at at least Tgc for a predetermined time period.

Figure 3:
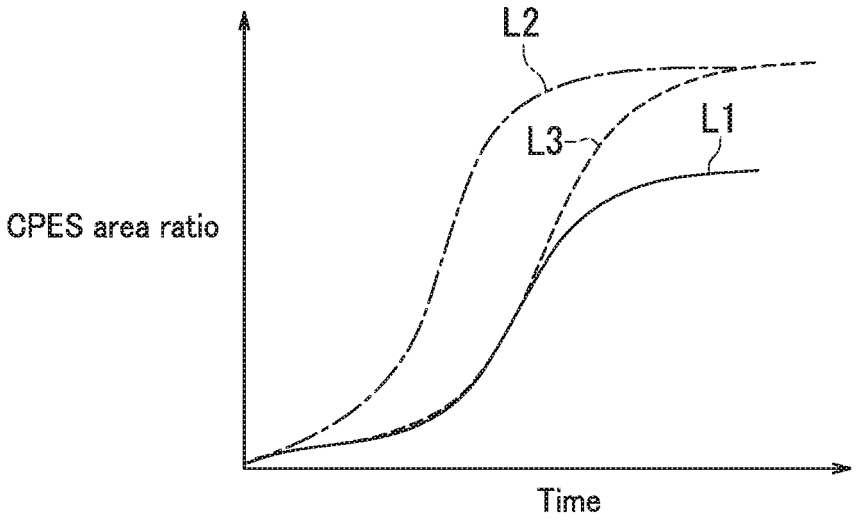
FIG. 3 is a diagram explaining a method for producing the electrostatic latent image developing toner according to the embodiment of the present disclosure.

The CPES area ratio can be controlled based on a temperature of the liquid in the crystallization process (also referred to below as a holding temperature), a time period for which the liquid is kept at the holding temperature in the crystallization process (also referred to below as a holding period), and an amount of the crystalline polyester resin to be added in the melt-kneading process (also referred to below as a crystalline polyester resin addition amount). FIG. 3 indicates a relationship between the CPES area ratio (vertical axis of the graph representation) and the holding period (horizontal axis of the graph representation). In FIG. 3, a line L1 represents transition of the CPES area ratio under a reference condition. A line L2 represents transition of the CPES area ratio under a condition where the holding temperature is higher than that in the condition for the line L1. A line L3 represents transition of the CPES area ratio under a condition where the crystalline polyester resin addition amount is larger than that in the condition for the line L1.

As indicated in FIG. 3, the longer the holding period is, the larger the CPES area ratio tends to be. As indicated by the line L2 in FIG. 3, the CPES area ratio tends to increase in a short period of time as the holding temperature is increased. As also indicated by the line L3 in FIG. 3, a saturation value of the CPES area ratio can be increased by increasing the crystalline polyester resin addition amount.

The CPES aspect ratio can be controlled based on the holding; temperature and the holding period. For example, when the holding temperature is increased, the CPES minor axis diameter tends to be long. The holding temperature has a greater influence on the CPES minor axis diameter than on the CPES major axis diameter. Furthermore, when the holding period is increased, the CPES major axis diameter tends to be long. The holding period has a greater influence on the CPES major axis diameter than on the CPES minor axis diameter.

(Melt-kneading Process)

The following describes an example of the melt-kneading process. In the melt-kneading process, toner materials including a non-crystallized crystalline polyester resin and a non-crystalline polyester resin (e.g., a non-crystallized crystalline polyester resin, a non-crystalline polyester resin, a colorant, a releasing agent, and a charge control agent) are mixed together to obtain a mixture. The resulting mixture is then melt-kneaded to obtain a melt-kneaded substance. A mixer (e.g., an FM mixer) can favorably be used for mixing the toner materials. The mixture can be favorably melt-kneaded for example using a two-axis extruder, a three-roll kneader, or a two-roll kneader. Note that a masterbatch containing a non-crystalline polyester resin and a colorant may be used as a toner material.

(Pulverization Process)

The following describes an example of the pulverization process. The melt-kneaded substance is first cooled to be solidified using a cooling and solidifying apparatus such as a drum linker. Subsequently, the resulting solidified substance is coarsely pulverized using a first pulverizer. Thereafter, the resulting coarsely pulverized substance is further pulverized using a second pulverizer to obtain a pulverized substance having a desired particle diameter (a powder of pre-crystallization particles). The resulting pulverized substance preferably has a roundness of at least 0.930 and no greater than 0.945 in terms of number average value.

(Crystallization Process)

Crystallization of the crystalline polyester resin is preferably performed in an aqueous medium in order to inhibit dissolution or elution of the toner components (particularly, the resins and the releasing agent). The aqueous medium is a medium containing water as a major component (specific examples include pure water and a mixed liquid of water and a polar medium). The aqueous medium may function as a solvent while a solute may be dissolved in the aqueous medium. Alternatively, the aqueous medium may function as a dispersion medium while a dispersoid may be dispersed in the aqueous medium. Examples of polar media that can be used in the aqueous medium include alcohols (specific examples include methanol and ethanol). The aqueous medium has a boiling point of approximately 100° C.

The pulverized substance obtained through the above pulverization process (a powder of pre-crystallization particles) and a dispersant having a mass average molecular weight of at least 3,000 and no greater than 20,000 are added to ion-exchanged water to obtain a liquid containing the pre-crystallization particles and the dispersant. Subsequently, the temperature of the liquid is increased to a holding temperature of at least the glass transition point (Tgc) of the pulverized substance at a specific rate (for example, a rate of at least 0.1° C./minute and no greater than 3° C./minute) while the liquid is stirred. The holding temperature is preferably at least Tgc and no greater than "Tgc+30° C.

The temperature of the liquid is kept at the holding temperature for a specific holding period (for example, at least 30 minutes and no greater than 120 minutes) while the liquid is stirred. It is thought that during the temperature of the liquid being kept at high temperature, the crystalline polyester resin in the pre-crystallization particles is crystallized and spheroidization of the pre-crystallization particles proceeds. The liquid is cooled to a temperature of less than Tgc (e.g., room temperature) when crystallization and spheroidization sufficiently proceed. Through the above, a dispersion of toner mother particles is obtained. The toner mother particles in the resulting dispersion preferably have a roundness of at least 0.950 and no greater than 0.970 in terms of number average value.

(Washing Process)

After the crystallization process, the toner another particles may be washed for example using water. The toner mother particles can be preferably washed in a manner for example that the dispersion containing the toner mother particles is subjected to solid-liquid separation to collect a wet cake of the toner mother particles and the collected wet cake of the toner mother particles is washed using water. Alternatively, the toner another particles can be preferably washed in a manner that the toner mother particles in the dispersion containing the toner mother particles are precipitated, a supernatant of the dispersion is replaced by water, and the toner mother particles are re-dispersed in the water after replacement.

(Drying Process)

The toner mother particles may be dried after the washing process. The toner mother particles can be dried for example using a dryer (specific examples include a spray dryer, a fluidized bed dryer, a vacuum freeze dryer, and a reduced pressure dryer). The toner mother particles are preferably dried using a spray dryer in order to inhibit agglomeration of the toner mother particles during drying. In a situation in which the spray dryer is used, the drying process and a later-described external addition process can be performed simultaneously by spraying a dispersion in which an external additive (specific examples include silica particles) is dispersed toward the toner mother particles.

(External Addition Process)

An external additive may be attached to the surfaces of the toner mother particles. The external additive can be attached to the surfaces of the toner mother particles by mixing the toner mother particles and the external additive (specific examples include silica particles) together using a mixer with a condition that the external additive is not embedded in the toner mother particles.

Through the above processes, a toner including multiple toner particles can be produced. Note that unnecessary processes may be omitted. In a situation for example in which a commercially available product can be directly used as a material, use of the commercially available product can omit a process of preparing the material. In a situation in which no external additive is attached to the surfaces of the toner mother particles (the external addition process is omitted), the toner mother particles and the toner particles are equivalent. In order to obtain a specific compound, a salt, an ester, a hydrate, or an anhydride of the compound may be used as a raw material thereof. Formation of multiple toner particles at the same time is preferable for efficient toner production. The toner particles produced at the same time are thought to have substantially the same configuration.

EXAMPLES

The following describes Examples of the present disclosure. Table 1 shows toners TA-1 to TA-8 and TB-1 to TB-6 according to Examples and Comparative Examples (each of which is an electrostatic latent image developing toner).

TABLE 1

| | Pulverized substance (Pre-crystallization particles) crystalline polyester resin | | | Crystallization process | | | | |
|---|---|---|---|---|---|---|---|---|
| | | | | Dispersant | | Holding | Holding | |
| Toner | addition amount [part by mass] | Tgc [° C.] | Roundness | Type | Mw | temperature | period | Roundness |
| TA-1 | 40 | 55 | 0.945 | $D_A$ | 3,000 | 60° C. | 30 min. | 0.954 |
| TA-2 | 40 | 55 | 0.945 | $D_A$ | 3,000 | 65° C. | 30 min. | 0.960 |
| TA-3 | 40 | 55 | 0.945 | $D_A$ | 3,000 | 55° C. | 60 min. | 0.952 |
| TA-4 | 40 | 55 | 0.945 | $D_A$ | 3,000 | 65° C. | 60 min. | 0.960 |
| TA-5 | 40 | 55 | 0.945 | $D_A$ | 3,000 | 70° C. | 60 min. | 0.966 |
| TA-6 | 40 | 55 | 0.945 | $D_A$ | 3,000 | 60° C. | 120 min. | 0.958 |
| TA-7 | 40 | 55 | 0.945 | $D_B$ | 20,000 | 70° C. | 60 min. | 0.951 |
| TA-8 | 20 | 60 | 0.940 | $D_A$ | 3,000 | 65° C. | 30 min. | 0.956 |

TABLE 1-continued

| Toner | Pulverized substance (Pre-crystallization particles) crystalline polyester resin addition amount [part by mass] | Tgc [° C.] | Roundness | Crystallization process Dispersant Type | Mw | Holding temperature | Holding period | Roundness |
|---|---|---|---|---|---|---|---|---|
| TB-1 | 40 | 55 | 0.945 | $D_A$ | 3,000 | 60° C. | 20 min. | 0.955 |
| TB-2 | 40 | 55 | 0.945 | $D_A$ | 3,000 | 65° C. | 150 min. | 0.963 |
| TB-3 | 40 | 55 | 0.945 | $D_A$ | 3,000 | 50° C. | 60 min. | 0.950 |
| TB-4 | 40 | 55 | 0.945 | $D_A$ | 3,000 | 75° C. | 60 min. | 0.970 |
| TB-5 | 40 | 55 | 0.945 | $D_C$ | 2,000 | 70° C. | 60 min. | 0.980 |
| TB-6 | 40 | 55 | 0.945 | $D_D$ | 22,000 | 70° C. | 60 min. | 0.945 |

The column titled. "Tgc" in Table 1 lists glass transition points of respective pulverized substances obtained through the melt-kneading process and the pulverization process.

In the column titled "Dispersant" in Table 1, $D_A$ to $D_D$ were as follows.

The dispersant $D_A$ was a water-soluble acrylic acid-based dispersant ("ARON (registered Japanese trademark) A-10SL" produced by Toagosei Co., Ltd., component: polyacrylic acid, solid concentration: 40% by mass, mass average molecular weight: 6,000).

The dispersant $D_B$ was an anionic surfactant ("SN-DISPERSANT 5020" produced by San Nopco Limited, component: polycarboxylic acid ammonium, solid concentration: 40% by mass, mass average molecular weight: 20,000).

The dispersant $D_C$ was a water-soluble acrylic acid-based dispersant ("ARON (registered Japanese trademark) A-6016A" produced by Toagosei Co., Ltd., component: sulfonic acid-based copolymer, solid concentration: 40% by mass, mass average molecular weight: 2,000).

The dispersant $D_D$ was an anionic surfactant ("SN-DISPERSANT 5022" produced by San Nopco Limited, component: polycarboxylic acid ammonium, solid concentration: 40% by mass, mass average molecular weight: 22,000).

The following describes production methods, evaluation methods, and evaluation results for the toners TA-1 to TA-8 and TB-1 to TB-6 in stated order. In evaluations in which errors may occur, an evaluation value was calculated by calculating the arithmetic mean of an appropriate number of measured values in order to ensure that any errors were sufficiently small. Respective measuring methods of roundness, glass transition point (Tg), melting point (Mp), and softening point (Tm) are as described below unless otherwise stated.

<Roundness Measuring Method>

Using a flow particle imaging analyzer ("FPIA (registered Japanese trademark)-3000" produced by Sysmex Corporation), roundness of 3,000 particles included in each of measurement targets was measured in an environment at a temperature of 23° C. and a relative humidity of 50%. The roundness of each particle was calculated based on an equation "(roundness)=$L_1/L_0$" ($L_0$: circumferential length of two-dimensional projected image of the particle, $L_1$: circumferential length of a circle having the same area as the two-dimensional projected image of the particle). A number average value of measured roundness values of the 3,000 particles was used as an evaluation value for the measurement target.

<Tg Measuring Method>

A differential scanning calorimeter ("DSC-6220" produced by Seiko Instruments Inc.) was used as a measuring device. Heat absorption curves of samples were plotted using the measuring device to obtain the glass transition point (Tg) of each of the samples. Specifically, approximately 10 mg of the sample (e.g., a resin) was put on an aluminum pan (aluminum vessel) and the aluminum pan was set in a measurement section of the measuring device. An empty aluminum pan was used as a reference. In plotting of a heat absorption curve, the temperature of the measurement section was increased from a measurement staring temperature of 25° C. to 200° C. at a rate of 10° C./minute (RUN1). Thereafter, the temperature of the measurement section was reduced from 200° C. to 25° C. at a rate of 10° C./minute. Subsequently, the temperature of the measurement section was re-increased from 25° C. to 200° C. at a rate of 10° C./minute (RUN2). Through RUN2, a heat absorption curve (vertical axis: heat flow (DSC signal), horizontal axis: temperature) of the sample was plotted. Tg of the sample was read from the plotted heat absorption curve. A temperature (onset temperature) at an inflection point due to glass transition (an intersection point of an extrapolation of the base line and an extrapolation of an inclined portion of the curve) on the heat absorption curve corresponds to the glass transition point (Tg) of the sample.

<Tm Measuring Method>

A sample (e.g., a polyester resin) was filled in a capillary rheometer ("CFT-500D" produced by Shimadzu Corporation) and an S-shaped curve (vertical axis: stroke, horizontal axis: temperature) of the sample was plotted by causing melt flow of 1 $cm^3$ of the sample under conditions of a die pore diameter of 1 mm, a plunger load of 20 $kg/cm^2$, and a heating rate of 6° C./minute. Subsequently, Tm of the sample was read from the plotted S-shaped curve. Tm (softening point) of the sample is a temperature on the S-shaped curve corresponding to a stroke value of "$(S_1+S_2)/2$", where $S_1$ represents a maximum stroke value and $S_2$ represents a base line stroke value at low temperatures.

<Mp Measuring Method>

A differential scanning calorimeter ("DSC-6220" produced by Seiko Instruments Inc.) was used as a measuring device. Heat absorption curves of respective samples were plotted using the measuring device to obtain the melting point (Mp) of each of the samples. Specifically, approximately 15 mg of the sample (e.g., a releasing agent or a resin) was put on an aluminum pan (aluminum vessel) and the aluminum pan was set in a measurement section of the measuring device. An empty aluminum pan was used as a reference. In plotting of the heat absorption curve, the temperature of the measurement section was increased from a measurement staring temperature of 30° C. to 170° C. at a rate of 10° C./minute. During the temperature increase, a heat absorption curve (vertical axis: heat flow (DSC signal), horizontal axis: temperature) of the sample was plotted. Mp of the sample was read from the plotted heat absorption curve. A temperature of a maximum peak originated from heat of fusion on the heat absorption curve corresponds to the melting point (Mp) of the sample.

[Preparation of Materials]

(Preparation of Non-crystalline Polyester Resin)

A reaction vessel was charged with 1,060 g of bisphenol A propylene oxide adduct, 688 g of bisphenol A ethylene oxide adduct, 109 g of alkenyl succinic anhydride, and 4 g of a catalyst (dibutyl tin oxide). After a nitrogen atmosphere was maintained in the reaction vessel, the internal temperature of the reaction vessel was increased up to 220° C. while the contents of the reaction vessel were stirred. Subsequent to reaction at a temperature of 220° C. for eight hours, the internal pressure of the reaction vessel was reduced to 8 kPa and reaction was performed for additional one hour. Thereafter, the inside of the reaction vessel was cooled to set the temperature of the reaction product at 210° C. and 285 g of fumaric acid was added to the reaction vessel. After fumaric acid was added, reaction was performed for one hour at a normal pressure and at a temperature of 210° C. The internal pressure of the reaction vessel was then reduced to 8 kPa and reaction was performed for additional five hours. After the reaction, the contents of the reaction vessel were taken out and cooled to obtain a non-crystalline polyester resin having a mass average molecular weight (Mw) of 10,000, a number average molecular weight (Mn) of 1,200, an acid value of 15 mgKOH/g, and a hydroxyl value of 30 mgKOH/g.

(Preparation of Crystalline Polyester Resin)

A 5-L four-necked flask equipped with a thermometer (thermocouple), a dewatering conduit, a nitrogen inlet tube, and a stirrer was charged with 990 g of 1,4-butanediol, 242 g of 1,6-hexanediol, 1,480 g of fumaric acid, and 2.5 g of 1,4-benzenediol. Subsequently, the flask contents were caused to react for five hours at a temperature of 170° C. The flask contents were then caused to react for 1.5 hours at a temperature of 210° C. The flask contents were next caused to react for one hour at a temperature of 210° C. in a reduced pressure atmosphere (a pressure of 8 kPa). The atmosphere was returned to a normal pressure atmosphere, and 70 g of styrene and 50 g of n-butyl methacrylate were added to the flask. Subsequently, the flask contents were caused to react for two hours at a temperature of 200° C. Next, the flask contents were caused to react for one hour at a temperature of 0.0° C. in a reduced pressure atmosphere (a pressure of 8 kPa). Through the above, a crystalline polyester resin having a softening point (Tm) of 80° C., a mass average molecular weight (Mw) of 15,500, and a number average molecular weight (Mn) of 3,000 was obtained.

[Toner Production Method]

(Preparation of Pulverized Substance)

An FM mixer ("FM-20B" produced by Nippon Coke & Engineering Co., Ltd.) was used to mix 50 parts by mass of a non-crystalline polyester resin having Tm of 125° C. (the non-crystalline polyester resin prepared by the method described above), a crystalline polyester resin (the crystalline polyester resin prepared by the method described above) in a corresponding one of the amounts listed in Table 1, 5 parts by mass of a colorant ("MA-100" produced by Mitsubishi Chemical Corporation, carbon black), and 5 parts by mass of a carnauba wax ("carnauba wax No. 1" produced by S. Kato & Co.) at a rotational speed of 2.400 rpm for 180 seconds. In production of for example the toner TA-8, the amount of the crystalline polyester resin was 20 parts by mass relative to 50 parts by mass of the non-crystalline polyester resin. In production of each of the other toners, the amount of the crystalline polyester resin was 40 parts by mass relative to 50 parts by mass of the non-crystalline polyester resin.

Next, the resulting mixture was melt-kneaded using a two-axis extruder ("PCM-30" produced by Ikegai Corp.) under conditions of a material feeding rate of 5 kg/hour, a shaft rotational speed of 150 rpm, and a cylinder temperature of 150° C. The resulting melt-kneaded substance was cooled then. Subsequently, the cooled melt-kneaded substance was coarsely pulverized using a pulverizer ("ROTOPLEX Type 16/8" produced by former Toa Machinery Mfg.). The resulting coarsely pulverized substance was then finely pulverized using a jet mill ("Ultrasonic jet mill Model I" produced by Nippon Pneumatic Mfg. Co., Ltd.). As a result, a pulverized substance having corresponding ones of properties indicated in the column titled "Pulverized substance (Pre-crystallization particles)" in Table 1 was obtained. In production of for example the toner TA-8, a pulverized substance (powder of pre-crystallization particles) having a glass transition point (Tg) of 60° C. and a roundness of 0.940 was obtained. In production of each of the other toners, a pulverized substance (powder of pre-crystallization particles) having a glass transition point (Tg) of 55° C. and a roundness of 0.945 was obtained. The roundness of the pulverized substance measured at that time corresponds to the roundness thereof at a crystallization process start. Tg of each of the toners was measured by the above-described differential scanning calorimetry. The roundness of each of the toners was measured by a method using the aforementioned flow particle imaging analyzer (FPIA-3000).

(Crystallization Process)

A 1-L three-necked flask equipped with a thermometer and a stirring impeller (paddle blade) was set in a water bath, and 300 mL of ion-exchanged water was added to the flask. Thereafter, the internal temperature of the flask was kept at 30° C. using the water bath. Subsequently, 1 mL of a corresponding one of the dispersants listed in Table 1 (one of the dispersants $D_A$ to $D_D$ defined for the toners) was added to the flask and the flask contents were stirred sufficiently. In production of for example the toner TA-1, 1 mL of the dispersant $D_A$ (ARON A-10SL) was added (see Table 1).

Next, 300 g of the pulverized substance prepared by the above-described method was added to the flask and the flask contents were stirred at a rotational speed (puddle blade) of 200 rpm for one hour. Thereafter, 500 mL of ion-exchanged water was added to the flask.

Subsequently, the internal temperature of the flask was increased to a corresponding one of temperatures indicated in the column titled "Holding temperature" in Table 1 (one of 50° C., 55° C., 60° C., 65° C., 70° C., and 75° C.) at a rate of 2° C./minute while the flask contents were stirred at a rotational speed of 100 rpm. In production of for example the toner TA-1, the internal temperature of the flask was increased up to 60° C. (see Table 1).

After reaching the holding temperature, the internal temperature of the flask was kept at the holding temperature for a corresponding one of time periods indicated in the column titled "Holding period" (period defined for a corresponding one of the toners: one of 20 minutes, 30 minutes, 60 minutes, 120 minutes, and 150 minutes) in Table 1 while the flask contents were stirred at a rotational speed of 100 rpm. In production of for example the toner TA-1, after reaching 60° C., the internal temperature of the flask was kept at 60° C. for additional 30 minutes (see Table 1). Thereafter, the flask contents were cooled to normal temperature (approximately 25° C.), thereby obtaining a dispersion of toner mother particles.

During the temperature of the liquid being kept at high temperature as above, the roundness of the toner mother particles in the liquid reached a corresponding one of values indicated in the column titled "Roundness (Crystallization process)" in Table 1. In production of for example the toner TA-1, the roundness of the toner mother particles after being cooled was 0.954 (see Table 1). The roundness of the pulverized substance (toner mother particles) measured at that time corresponds to the roundness thereof (toner mother particles) at a crystallization process end.

(Washing Process)

The dispersion of the toner mother particles obtained as above was filtrated (solid-liquid separation) using a Buchner funnel. As a result, a wet cake of the toner mother particles was collected. The resulting wet cake of the toner mother particles was then re-dispersed in ion-exchanged water. Dispersion and filtration were repeated five times in total to wash the toner mother particles.

(Drying Process)

Subsequently, the washed toner mother particles (a powder) were dispersed in an aqueous ethanol solution at a concentration of 50% by mass to obtain a slurry of the toner mother particles. The toner mother particles in the slurry were then dried using a continuous type surface modifier ("COATMIZER (registered Japanese trademark)" produced by Freund Corporation) wider conditions of a hot air temperature of 45° C. and a flow rate of 2 $m^3$/minute. As a result, dried toner mother particles (powder) were obtained.

(Classification Process)

The dried toner mother particles (a powder) were then classified using a classifier ("Elbow Jet Model EJ-LABO" produced by Nittetsu Mining Co., Ltd.). As a result, toner mother particles (a powder) having a volume median diameter ($D_{50}$) of 8.0 μm were obtained.

(External Addition Process)

A 10-L FM mixer (product of Nippon Coke & Engineering Co., Ltd.) was used to mix 100 parts by mass of the toner mother particles and 0.5 parts by mass of positively chargeable silica particles ("AEROSIL (registered Japanese trademark) REA90" produced by Nippon Aerosil Co., Ltd., content: dried silica particles to which positive chargeability has been imparted through surface treatment, number average primary particle diameter: 20 nm) for five minutes so that an external additive (silica particles) was attached to the surfaces of the toner mother particles. Thereafter, the resulting powder was sifted using a 200-mesh sieve (opening 75 μm). Thus, a toner including a plurality of toner particles was produced.

The toner particles included in the respective toners TA-1 to TA-8 and TB-1 to TB-6 produced as above each contained a CPES dispersoid (dispersoid of crystallized crystalline polyester resin domains). Table 2 lists a CPES area ratio measured for the CPES dispersoid of each toner, and a CPES minor axis diameter, a CPES major axis diameter, and a CPES aspect ratio measured for the CPES domains in the CPES dispersoid of each toner. The roundness values (roundness after external addition) of the toners each were measured and found to be the same as a corresponding one of the values indicated in the column titled "Roundness (Crystallization process)" in Table 1.

TABLE 2

| | CPES | | | |
|---|---|---|---|---|
| Toner | Area ratio [%] | Minor axis diameter [μm] | Major axis diameter [μm] | Aspect ratio |
| TA-1 | 10.0 | 0.10 | 0.50 | 5.00 |
| TA-2 | 10.5 | 0.15 | 0.52 | 3.47 |
| TA-3 | 17.8 | 0.05 | 0.50 | 10.0 |
| TA-4 | 20.1 | 0.15 | 0.65 | 4.33 |
| TA-5 | 28.4 | 0.20 | 0.68 | 3.40 |
| TA-6 | 29.5 | 0.12 | 0.85 | 7.08 |
| TA-7 | 28.6 | 0.25 | 0.88 | 3.52 |
| TA-8 | 10.2 | 0.14 | 0.50 | 3.57 |
| TB-1 | 9.4 | 0.10 | 0.45 | 4.50 |
| TB-2 | 34.2 | 0.17 | 0.91 | 5.35 |
| TB-3 | 10.1 | 0.02 | 0.30 | 15.0 |
| TB-4 | 29.8 | 0.26 | 0.68 | 2.62 |
| TB-5 | 29.4 | 0.20 | 0.70 | 3.50 |
| TB-6 | 28.8 | 0.26 | 0.90 | 3.46 |

For example, the toner TA-1 had a CPES area ratio of 10.0%, a CPES minor axis diameter of 0.10 μm, a CPES major axis diameter of 0.50 μm, and a CPES aspect ratio of 5.00.

(Capturer of Cross-sectional Image of Toner Particle)

A sample (toner) was dispersed in a cold-setting epoxy resin and embedded in the resin, thereby obtaining a cured product. Subsequently, a polystyrene powder having a particle diameter of approximately 100 nm was added to the resulting cured product and a resulting substance was pressed using a press molding apparatus. A block as a result of the pressing was then dyed with ruthenium tetroxide and osmium tetroxide and sliced using a ultramicrotome including a diamond knife ("EM UC6" produced by Leica Microsystems K.K.), thereby obtaining a thin sample piece. A cross-sectional image of the thin sample piece was captured at a magnification of 10,000× using a transmission electron microscope (TEM, "JEM-2000FX" produced by JEOL Ltd.). The captured cross-sectional image of the thin sample piece included a section of a single toner particle. The contrast of the captured image was adjusted with reference to crystalline polyester resin domains (portions indicated black on the image) and releasing agent domains (portions indicated white on the image).

<Measuring Methods for Minor Axis Diameter, Major Axis Diameter, and Aspect Ratio of CPES Domains>

The image captured as above was analyzed using image analysis software ("WinROOF" produced by Mitani Corporation) to measure the minor axis diameter and the major axis diameter of each of CPES domains (crystallized crystalline polyester resin domains) present in each toner mother particle. An aspect ratio (major axis diameter)/(minor axis diameter)) was calculated by dividing the major axis diameter by the minor axis diameter for each of the CPES domains.

Dimension values (minor axis diameter, major axis diameter, and aspect ratio) of 10 CPES domains in a single toner particle were measured while the field of view was changed. The arithmetic mean value of 10 values measured for each of the dimension values (minor axis diameter, major axis diameter, and aspect ratio) was determined to be dimension value (minor axis diameter, major axis diameter, or aspect ratio) of the single toner particle that was a measurement target. The respective dimension values (minor axis diameter, major axis diameter, and aspect ratio) of each of 10 toner particles included in a sample (toner) were measured. Respective number average values for the 10 toner particles were determined to be evaluation values (minor axis diameter, major axis diameter, and aspect ratio of CPES domains) of the sample (toner).

<Measuring Method for CPES Area Ratio>

The image captured as above was analyzed using image analysis software ("WinROOF" produced by Mitani Corporation) to calculate the CPES area ratio (ratio of a total area occupied by the CPES dispersoid to the cross-sectional area of the toner particle). The cross-sectional area of the toner particle and the total area of all the CPES domains (crystallized crystalline polyester resin domains) present in the cross-sectional image of the toner particle were measured in the cross-sectional image of the toner particle. Regions of the CPES domains were distinguished from the other region in a sectional region of the toner mother particle using a binary function of the image analysis software (WinROOF). The total area of all the CPES domains present in the toner mother particle was obtained also using a measurement function of the image analysis software (WinROOF). The CPES area ratio was calculated by dividing the total area of all the CPES domains present in the toner mother particle by the cross-sectional area of the toner particle. Respective CPES area ratios of 10 toner particles included in each sample (toner) were calculated. A number average value for the 10 toner particles was determined to be an evaluation value (CPES area ratio) of the sample (toner).

[Evaluation Method]

Each of samples (toners TA-1 to TA-8 and TB-1 to TB-6) was evaluated by the following evaluation methods.

(Heat-resistant Preservability)

A 20-mL polyethylene container was charged with 3 g of the sample (toner) and left to stand for three hours in a thermostatic chamber set at 55° C. Thereafter, the toner taken out from the thermostatic chamber was cooled to room temperature (approximately 25° C.) to obtain an evaluation toner.

Subsequently, the resulting evaluation toner was put on a 200-mesh sieve (opening 75 μm) of known mass. A mass of the toner on the sieve (mass of the toner prior to sifting) was obtained by measuring the total mass of the toner and the sieve. The sieve was then placed in a powder characteristic evaluation apparatus ("POWDER TESTER (registered Japanese trademark)" produced by Hosokawa Micron Corporation), and the evaluation toner was sifted in accordance with a manual of the powder tester by shaking the sieve for 30 seconds at a rheostat level of 5. The total mass of the sieve and toner on the sieve was measured after the sifting to obtain a mass of toner remaining on the sieve (mass of toner after sifting). A toner passing rate $W_0$ (unit: % by mass) was calculated using the following equation based on a mass $W_1$ of the toner before sifting and a mass $W_2$ of the toner after sifting.

$$W_0=100\times(W_1-W_2)/W_1$$

A toner having a toner passing rate of at least 90% mass was evaluated as "very good". A toner having a toner passing rate of at least 80% by mass and less than 90% by mass was evaluated as "good". A toner having a toner passing rate of less than 80% by mass was evaluated as "poor".

(Preparation of Two-component Developer)

A two-component developer was prepared by mixing 100 parts by mass of a developer carrier (carrier for "FS-C5250DN" produced by KYOCERA Document Solutions Inc.) and 5 parts by mass of a toner (evaluation target: one of the toners TA-1 to TA-8 and TB-1 to TB-6) for 30 minutes using a ball mill.

(Low-temperature Fixability)

A printer having a roller-roller type heat-pressure fixing device ("FS-C5250DN" produced by KYOCERA Document Solutions Inc., modified to enable adjustment of fixing temperature) was used as an evaluation apparatus. The two-component developer prepared as above was loaded into a development device of the evaluation apparatus, and toner for replenishment use (evaluation target: a corresponding one of the toners TA-1 to TA-8 and TB-1 to TB-6) was loaded into a toner container of the evaluation apparatus.

A solid image having a size of 25 mm by 25 mm was formed on paper (A4-size plain paper) using the evaluation apparatus under conditions of a linear velocity of 200 mm/second and a toner application amount of 1.0 mg/cm$^2$ in an environment at a temperature of 23° C. and a relative humidity of 50%. Subsequently, the paper having the image (specifically, unfixed solid image) formed thereon was passed through the fixing device of the evaluation apparatus.

A selling range of the fixing temperature in evaluation of low-temperature fixability of each of the toners ranged from 100° C. to 200° C. The fixing temperature of the fixing device was increased from 100° C. in increments of 1° C. to measure a minimum temperature at which the solid image (toner image) could be fixed to the paper (minimum fixing temperature). Whether or not the toner could be fixed was determined by performing the following fold-rubbing test. Specifically, the fold and rubbing test was performed by folding the paper having been passed through the fixing device in half such that a surface on which the image was formed was folded inwards and by rubbing using a 1-kg weight covered with cloth back and forth on the fold five times. Then, the paper was unfolded to observe the folded portion of the paper (portion on which the solid image was formed). The length of toner peeling of the fold portion (peeling length) was measured. A minimum temperature among fixing temperatures for which the peeling length was no greater than 1 mm was determined to be the lowest fixing temperature. A toner having a lowest fixing temperature of no greater than 140° C. was evaluated as "very good". A toner having a lowest fixing temperature of greater than 140° C. and no greater than 150° C. was evaluated as "good". A toner having a lowest fixing temperature of greater than 150° C. was evaluated as "poor".

(Image Density)

A printer ("TASKalfa 500ci" produced by KYOCERA Document Solutions Inc.) was used as an evaluation apparatus. The two-component developer prepared as above was loaded into a development device of the evaluation apparatus, and toner for replenishment use (evaluation target: one of the toners TA-1 to TA-8 and TB-1 to TB-6) was loaded into a toner container of the evaluation apparatus. For the development device of the evaluation apparatus, an alternating current voltage (Vpp) applied to a magnet roll was set at 2.0 kV and a voltage between a development sleeve and the magnet roll was adjusted to approximately 250 V.

Continuous printing at a printing rate of 4% was performed on 5,000 pieces of paper (A4-size plain paper) using the evaluation apparatus in an environment at a temperature of 10° C. and a relative humidity of 10%. A solid image at a printing rate of 100% was output on the entirety of a piece of paper (A4-size plain paper) after every continuous printing on 1,000 pieces of paper from printing start in the continuous printing, and image density of each of resulting solid images was measured. The image density was measured using a reflectance densitometer ("SPECTROEYE (registered Japanese trademark)" produced by X-Rite Inc.).

A general tendency for the image density to reduce as the cumulative number of printed pieces was increased was observed. A toner was evaluated as "very good" when the image density after printing on 5,000 cumulative pieces was at least 1.20. A toner was evaluated as "good" when the image density after printing on 5,000 cumulative pieces was less than 1.20 and the image density after printing on 4,000 cumulative pieces was at least 1.20. A toner was evaluated as "poor" when the image density after printing on 4,000 cumulative pieces was less than 1.20.

(Waste Toner Amount)

Toner was collected in a waste toner container of the evaluation apparatus in the continuous printing for evaluation of the image density. The amount of the collected toner (waste toner) was measured. The waste toner corresponds to toner having been discharged from the toner container and not having been transferred to the paper.

A toner was evaluated as "very good" when the amount of waste toner was no greater than 10.0 g. A toner was evaluated as "good" when the amount of waste toner was greater than 10.0 g and no greater than 15.0 g. A toner was evaluated as "poor" when the amount of waste toner was greater than 15.0 g.

(Ease of Toner Cleaning)

A printer ("TASKalfa 500ci" produced by KYOCERA Document Solutions Inc.) was used as an evaluation apparatus. The two-component developer prepared as above was loaded into a development device of the evaluation apparatus, and toner for replenishment use (evaluation target: one of the toners TA-1 to TA-8 and TB-1 to TB-6) was loaded into a toner container of the evaluation apparatus. For the development device of the evaluation apparatus, an alternating current voltage (Vpp) applied to a magnet roll was set at 2.0 kV and a voltage between a development sleeve and the magnet roll was adjusted at approximately 250 V.

Continuous printing at a printing rate of 4% was performed on 5,000 pieces of paper (A4-size plain paper) using the evaluation apparatus in an environment at a temperature of 25° C. and a relative humidity of 50%. After the continuous printing on 5,000 pieces of paper, a solid image at a printing rate of 100% was output on the entirety of a piece of paper (A4-size plain paper) and a halftone image at a printing rate of 50% was subsequently output on the entirety of a piece of paper (A4-size plain paper). Whether or not any of color points and image voids are present in the output solid image and the output halftone image was visually checked. Furthermore, the presence or absence of adhesion of any toner components onto the surface of a photosensitive member of the evaluation apparatus was visually confirmed after formation of the solid image and the halftone image. Ease of toner cleaning was evaluated in accordance with the following criteria based on results of the visual observation.

"Very good": Neither color points nor image voids were observed in both the solid image and the halftone image, and no toner component adhered to the surface of the photosensitive member.

"Good": Neither color points nor image voids were observed in both the solid image and the halftone image, but a toner component adhered to the surface of the photosensitive member.

"Poor": A color point or an image void was observed in either or both of the solid image and the halftone image and a toner component adhered to the surface of the photosensitive member.

[Evaluation Result]

Heat-resistant preservability (toner passing rate), low-temperature fixability (lowest fixing temperature), image density (image density after printing on 4,000 cumulative pieces and image density after printing on 5,000 cumulative pieces), a waste toner amount, and ease of toner cleaning were evaluated for each of the samples (the toners TA-1 to TA-8 and TB-1 to TB-6), of which results are shown in Table 3.

TABLE 3

| Toner | Heat-resistant preservability [%] | Low-temperature fixability [° C.] | Image density 4,000-piece | Image density 5,000-piece | Waste toner amount [g] | Ease of toner cleaning |
|---|---|---|---|---|---|---|
| TA-1 | 80 | 128 | 1.22 | 1.22 | 11.1 | Very good |
| TA-2 | 82 | 130 | 1.22 | 1.21 | 9.5 | Very good |
| TA-3 | 86 | 136 | 1.22 | 1.17 | 12.3 | Very good |
| TA-4 | 90 | 138 | 1.23 | 1.21 | 8.7 | Very good |
| TA-5 | 95 | 145 | 1.24 | 1.22 | 8.0 | Good |
| TA-6 | 95 | 148 | 1.20 | 1.15 | 10.8 | Very good |
| TA-7 | 95 | 145 | 1.22 | 1.22 | 14.1 | Very good |
| TA-8 | 95 | 140 | 1.25 | 1.24 | 8.8 | Very good |
| TB-1 | 72 | 120 | 1.21 | 1.16 | 14.9 | Very good |
| TB-2 | 97 | 155 | 1.22 | 1.17 | 7.2 | Very good |
| TB-3 | 82 | 124 | 1.16 | 1.15 | 15.0 | Very good |
| TB-4 | 90 | 148 | 1.10 | 1.11 | 10.0 | Good |
| TB-5 | 91 | 150 | 1.23 | 1.22 | 5.8 | Poor |
| TB-6 | 90 | 142 | 1.23 | 1.21 | 20.2 | Very good |

Each of the toners TA-1 to TA-8 (toners according to Examples 1 to 8) had the aforementioned basic features. Specifically, each of the toners TA-1 to TA-8 included toner particles containing a non-crystalline polyester resin and a CPES dispersoid (dispersoid of crystallized crystalline polyester resin domains). CPES domains of the CPES dispersoid had an aspect ratio of at least 3.40 and no greater than 10.0 in terms of number average value (see Table 2). The toner particles had a roundness of at least 0.950 and no greater than 0.970 in terms of number average value (see Table 1). In a cross-sectional image of each of the toner particles, a ratio of a total area occupied by the CPES dispersoid to a cross-sectional area of the toner particle was at least 10.0% and no greater than 30.0% (see Table 2).

As shown in Table 3, each of the toners TA-1 to TA-8 (toners according to Examples 1 to 8) was excellent in heat-resistant preservability, low-temperature fixability, chargeability, and ease of toner cleaning.

What is claimed is:

1. An electrostatic latent image developing toner comprising a plurality of toner particles containing a non-crystalline polyester resin and a crystalline polyester resin, wherein the toner particles contain as the crystalline polyester resin a dispersoid of crystallized crystalline polyester resin domains (CPES), the CPES domains of the CPES dispersoid have an aspect ratio of at least 3.40 and no greater than 10.0 in terms of number average value, the toner particles have a roundness of at least 0.950 and no greater than 0.970 in terms of number average value, in a cross-sectional image of each of the toner particles, a ratio of a total area occupied by the CPES dispersoid to a cross-sectional area of the toner particle is at least 10.0% and no greater than 30.0%, the non-crystalline polyester resin includes a repeating unit derived from alkenyl succinic anhydride, and the crystalline polyester resin includes a repeating unit derived from n-butyl methacrylate.

2. The electrostatic latent image developing toner according to claim 1, wherein the CPES domains of the CPES dispersoid have a major axis diameter of at least 0.50 μm and no greater than 1.00 μm in terms of number average value, and the CPES domains of the CPES dispersoid have a minor axis diameter of at least 0.05 μm and no greater than 0.25 μm in terms of number average value.

3. The electrostatic latent image developing toner according to claim 1, wherein the crystalline polyester resin is contained in an amount of at least 40 parts by mass and no greater than 95 parts by mass relative to 100 parts by mass of the non-crystalline polyester resin, the non-crystalline polyester resin has a softening point measured by differential scanning calorimetry of at least 110° C. and no greater than 140° C., and the crystalline polyester resin has a softening point measured by differential scanning calorimetry of at least 75° C. and no greater than 90° C.

4. The electrostatic latent image developing toner according to claim 3, wherein the non-crystalline polyester resin contains a bisphenol as an alcohol component, and the crystalline polyester resin constituting the crystalline polyester resin domains is a polymer of monomers including at least one alcohol monomer, at least one carboxylic acid monomer, at least one styrene-based monomer, and n-butyl methacrylate.

5. The electrostatic latent image developing toner according to claim 1, wherein the electrostatic latent image developing toner is a pulverized toner.

6. The electrostatic latent image developing toner according to claim 1, wherein the non-crystalline polyester resin has an acid value of at least 5 mg KOH/g and no greater than 30 mg KOH/g.

7. The electrostatic latent image developing toner according to claim 1, wherein the non-crystalline polyester resin has a hydroxyl value of at least 20 mg KOH/g and no greater than 40 mg KOH/g.

* * * * *